US007930982B2

(12) United States Patent
Surget

(10) Patent No.: US 7,930,982 B2
(45) Date of Patent: Apr. 26, 2011

(54) SUPPORT FOR EMBROIDERY FILM

(76) Inventor: Sekip Surget, Krefeld (DE)

( * ) Notice: Subject to any disclaimer, the term of this patent is extended or adjusted under 35 U.S.C. 154(b) by 481 days.

(21) Appl. No.: 11/718,877

(22) PCT Filed: Sep. 1, 2005

(86) PCT No.: PCT/EP2005/009395

§ 371 (c)(1),
(2), (4) Date: Dec. 12, 2007

(87) PCT Pub. No.: WO2006/048066

PCT Pub. Date: May 11, 2006

(65) Prior Publication Data

US 2008/0092791 A1 Apr. 24, 2008

(30) Foreign Application Priority Data

Nov. 8, 2004 (DE) ..... 10 2004 054 121

(51) Int. Cl.
*D05C 9/04* (2006.01)
*D05B 21/00* (2006.01)

(52) U.S. Cl. ..... 112/103

(58) Field of Classification Search ..... 112/102, 112/103, 102.5, 117–119; 38/102, 102.2, 38/102.91; 428/98, 134
See application file for complete search history.

(56) References Cited

U.S. PATENT DOCUMENTS

| | | | | |
|---|---|---|---|---|
| 3,599,583 | A * | 8/1971 | Berman et al. | 112/470.09 |
| 4,467,735 | A * | 8/1984 | Sadeh | 112/470.14 |
| 4,487,645 | A * | 12/1984 | Weston | 156/157 |
| 4,636,099 | A * | 1/1987 | Goldstone | 400/531 |
| 4,640,529 | A * | 2/1987 | Katz | 281/5 |
| 4,682,551 | A * | 7/1987 | Toman | 112/103 |
| 4,706,583 | A | 11/1987 | Darbenzio | |
| 4,810,006 | A * | 3/1989 | Katz | 281/5 |
| 4,981,092 | A | 1/1991 | Bauman et al. | |
| 4,993,333 | A | 2/1991 | Moore, III | |
| 5,144,899 | A | 9/1992 | Allen | |
| 5,375,543 | A * | 12/1994 | Birman | 112/470.14 |
| 5,546,877 | A * | 8/1996 | Moore | 112/103 |
| 5,691,023 | A * | 11/1997 | Keller | 428/43 |
| 5,809,918 | A * | 9/1998 | Tajima et al. | 112/103 |
| 5,865,137 | A * | 2/1999 | Frye | 112/470.14 |
| 5,915,315 | A * | 6/1999 | Bentz | 112/103 |
| 6,880,471 | B2 * | 4/2005 | Taijima et al. | 112/102 |
| 6,925,946 | B1 * | 8/2005 | Kang | 112/102.5 |
| 7,377,222 | B1 * | 5/2008 | Moore, III | 112/470.14 |
| 2009/0123695 | A1 * | 5/2009 | Han | 428/134 |

FOREIGN PATENT DOCUMENTS

| | | |
|---|---|---|
| FR | 2 684 394 | 6/1993 |
| GB | 2 071 171 | 9/1981 |
| GB | 2 257 717 | 1/1993 |

* cited by examiner

*Primary Examiner* — Ismael Izaguirre
(74) *Attorney, Agent, or Firm* — Robert W. Becker; Robert Becker & Associates

(57) ABSTRACT

A support for a support material that is to be embroidered, comprising a strip-shaped support that in a conveying direction thereof and/or transversely to the conveying direction is provided with a plurality of window-like openings for passage of an embroidery needle, wherein the window-like openings are adapted to be covered by the support material. A conveying device is provided and has a drive mechanism for displacing the strip-shaped support. An embroidery machine or sawing machine incorporating the conveying device is also provided.

38 Claims, 19 Drawing Sheets

SUPPORT FOR EMBROIDERY FILM

BACKGROUND OF THE INVENTION

The instant application should be granted the priority dates of Nov. 8, 2004, the filing date of the corresponding German patent application 10 2004 054 121.3, as well as Sep. 1, 2005, the filing date of the International patent application PCT/EP2005/009395.

The present invention relates to a support for a support material for embroidering, to a conveying device for the support according to the invention, which support is constructed in particular as a support strip, and to an embroidery machine, with conveying device arranged thereon, for embroidering the support material.

As a rule embroideries are embroidered directly onto the fabric for embroidering, the fabric being inserted into corresponding hoops and secured. During insertion care must always be taken that the fabric for embroidering is flat and positioned exactly in the hoop. This can usually only be carried out by experienced employees in a time-consuming operation.

It is also known to embroider strip-shaped materials, the strip being conveyed beneath the embroidering head using a conveying device. The strip-shaped materials are used to produce name badges, etc. It is also known to position water-soluble or heat-soluble support films manually in hoops, whereby the hoop is secured to a drive device for movement in the X-Y plane on the embroidery machine and thereafter the support material is embroidered by means of the embroidery machine. Once the support material has been embroidered it can be released from the hoop or be dissolved by means of water of heat. Prefabricated emblems are also known which are fixed in the hoop in order to be embroidered to order. The problem of exact positioning in the hoop and exact positioning of the embroidered support material on an object to which the embroidery is to be sewn occurs again in this case.

The object of the present invention is to provide a support which carries a support material for embroidering, in other words a support material that is adapted to be embroidered, so that via the support the support material can be fed in a pre-positioned manner to an embroidery machine. It is also an object of the present invention to provide a conveying device and an embroidery machine for feeding and embroidering the support according to the invention.

SUMMARY OF INVENTION

This object is achieved according to the invention by a strip-shaped support that in a conveying direction thereof and/or transversely to the conveying direction is provided with a plurality of window-like openings for passage of an embroidering needle, wherein the window-like openings are adapted to be covered by the support material that is adapted to be embroidered. Advantageous embodiments of the support can be found in the dependent claim. The invention also claims a conveying device for advancing the strip-shaped support and comprising at least one drive mechanism for displacement of the conveying device in at least one of the X and Y directions, securing means for securement to the drive mechanism, and a drive, wherein the strip-shaped support is adapted to be moved in or counter to the conveying direction by the drive, wherein the conveying device has at least one passage for at least one embroidery needle, and wherein at least one of the window-like openings of the stripshaped support is adapted to be positioned over the at least one passage for embroidery of the support material. Also claimed is an embroidery machine for embroidering the strip-shaped support, with support material for embroidering situated thereon, which machine comprises at least one conveying device wherein the drive mechanism for a hoop, is adapted to displace the conveying device in at least one of the X and Y directions.

The in particular strip-shaped, support according to the invention is advantageously characterized in that the support material for embroidering is secured to the support or support strip so as to be already pre-positioned. Consequently the pre-positioned support material can be fed to the embroidery machine quickly and, in particular, automatically. The support or the support strip is preferably made from a bend-resistant material, so that the support or support strip itself forms a type of hoop for the support material for embroidering and holds this so it is tensioned during and after the embroidering process.

The support material for embroidering can be fabric or a water-soluble or heat-soluble embroidery film, such as the Madeiras® film which consists 100% of polyolefin at a strength of 100 microns (approx. 0.1 mm).

The support strip according to the invention is preferably made of relatively bend-resistant and twist-resistant material which forms window-like passages or openings which are covered by the support material for embroidering. It is consequently possible to automatically position the support strip according to the invention under a needle of an embroidery machine such that the machine, by means of its hoop drives, moves the support strip and can embroider the embroidery onto the support material. Of course it is possible that a cutting mechanism separates from each other the individual windows or passages formed by the support strip after embroidering.

The support strip can advantageously comprise perforations which, in particular, extend transversely to the longitudinal extent of the support strip, and therefore easy manual separation of the individual windows formed by the support strip and covered by the support material is possible. Following separation the windows of the support strip form a stable frame on which the embroidered support material continues to be taut and tensioned, whereby it may be positioned relatively easily and without difficulty on a backing or base onto which the embroidery together with the support material can be sewn. If a soluble support material is used it may be dissolved from the embroidery, for example by means of heat or water, prior to sewing onto the backing or object. However, it is also possible to dissolve the support material after sewing onto the objects.

In a further embodiment of the support strip according to the invention an object for embroidering, which can be exactly positioned relative to the embroidery machine by means of the support strip itself, can be applied or secured to the support material.

As a result of the fact that the support strip according to the invention can, in principle, be configured so as to be infinitely long and over its entire length forms a large number of passages, a large number of embroideries can be embroidered onto the support material or the object situated thereon. Manual intervention is only very seldom required as a result.

Of course it is not only possible for the passages to be arranged side by side in the conveying or advancing direction, rather it is also possible to arrange passages side by side transversely to the conveying direction, and, in particular, these are separated from each other by a bend-resistant web. It is also possible for one and the same support strip to comprise passages of different sizes and/or alternately arranged passages for embroidering support materials of different sizes.

The support strip can also comprise markings, by means of which the support strip may be exactly positioned in a conveying device, so that the embroidery machine can embroider the support material of the support strip with a high level of accuracy of repetition.

To ensure exact advancing of the support strip it is advantageously possible for the support strip to comprise catching openings for pull-type conveying, similar to those in the case of continuous printers. The catching openings can be provided on the two longitudinal sides of the support strip at equidistant intervals. However, it is also possible for the longitudinal sides of the support strip to comprise contact pressure surfaces for conveying rollers which are pressed onto the support strip from above or below or from both sides.

The invention also includes a conveying device for the support strip according to the invention. The conveying device can advantageously be secured to the hoop drive of the embroidery machine such that the support strip lying in the conveying device can be moved in the X-Y direction by the hoop drive for stitching. It is of course possible for the advancing drive of the conveying device to be used for the movement of the support strip in the X or Y direction for stitching. The corresponding hoop drive of the embroidery machine can then be turned off.

The conveying device can moreover drive the conveying belt by means of pressure rollers, sprocket wheel rollers or belts having corresponding sprockets. The conveying device can moreover have a frame which forms at least one passage for the passing-through of one or more embroidery needle (s). The passage can be divided into a plurality of passages by a plurality of webs, the webs forming supports for the conveying belt. The passages should be at least as large as the window-like openings of the support strip.

The conveying device can moreover advantageously comprise two shafts, of which at least one is driven. The pressure rollers, sprocket wheel rollers or belts are fastened to the shafts. If a plurality of conveying devices is arranged on a multi-head embroidery machine, they can be driven by a single drive or a common drive, for example by using a continuous drive shaft.

It is also possible to arrange a separating device, for example in the form of a cutting mechanism, on the conveying device, so that the conveying belt can be automatically cut after embroidering.

A feed device, which moves for example with the conveying device in the X-Y direction, for a conveying belt may also be secured to the conveying device, so that no relative movements occur between the feed device and the conveying device as a result of the movement of the hoop drive in the X-Y plane, which relative movements could impair the material of the conveying belt.

Of course it is also possible to embroider the support according to the invention by means of a sewing machine. The conveying device can also be arranged on an embroidery or sewing machine.

BRIEF DESCRIPTION OF THE DRAWINGS

Possible embodiments of the conveying belt according to the invention and the conveying device according to the invention and an embroidery machine according to the invention will be described in more detail hereinafter with reference to drawings, in which.

DESCRIPTION OF PREFERRED EMBODIMENTS

Figure 1:
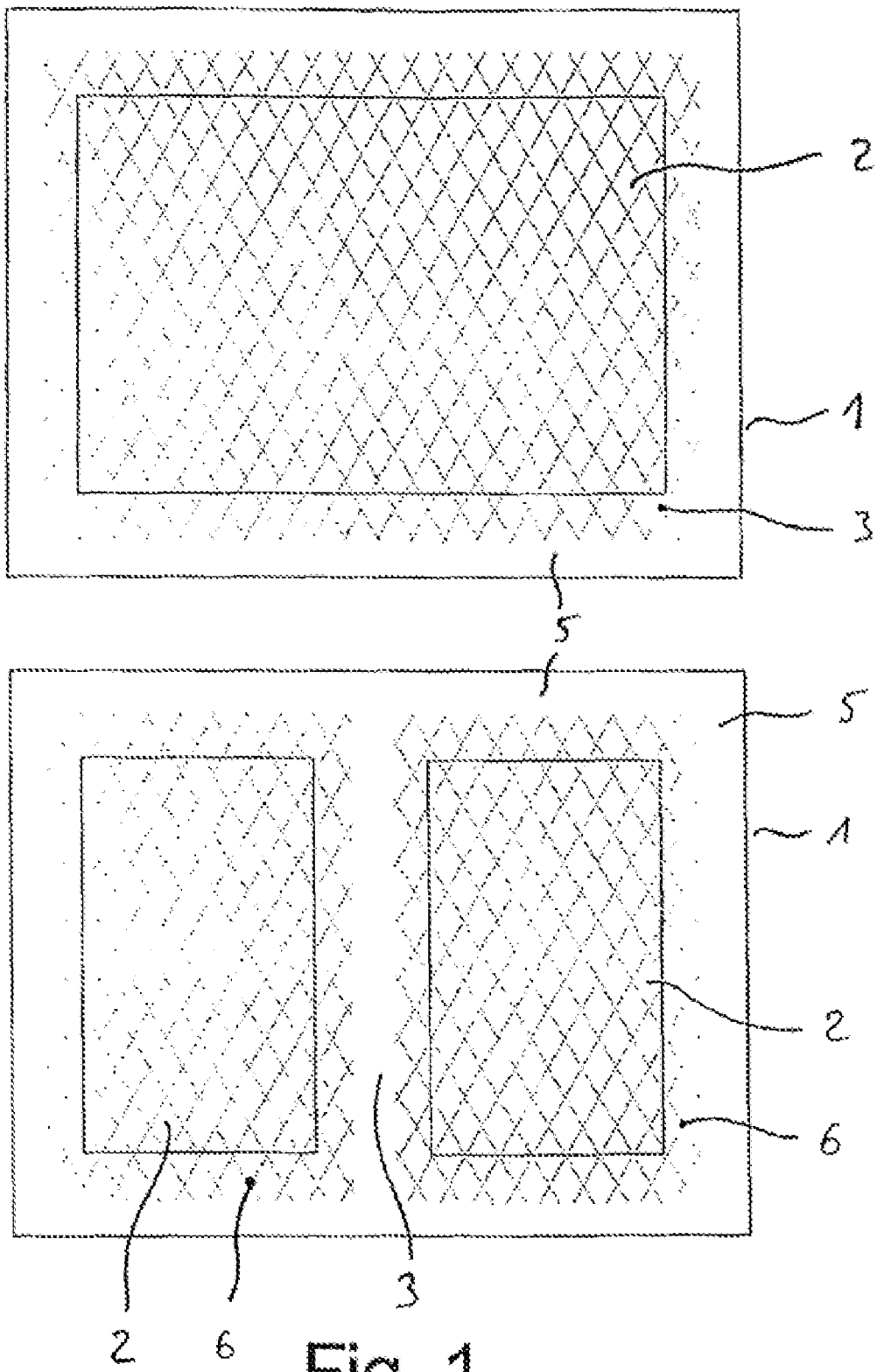
FIG. 1 shows two possible embodiments of the support according to the invention having the support material for embroidering.

FIG. 1 shows two possible embodiments of the support 1 according to the invention which is made from a bend-resistant material. In the upper embodiment the support comprises only one window-like opening 2 which is covered by the support material 6 for embroidering. The support material 6 can be fastened to the material of the support 1 using a wide variety of joining techniques. The opening 2 is surrounded by an edge 5 which ensures that the support material 6 for embroidering is always fixed so as to be taut. The lower embodiment illustrated in FIG. 1 shows a support with two window-like openings 2 of the same size and which are separated from each other by a web or crosspiece 3. The support material 6 for embroidering is constructed in two parts, one part respectively covering an opening 2, so embroidering of the left-hand support material does not affect the right-hand support material 6, so exact embroideries may be achieved. Of course it is possible for the support material 6 covering a plurality of openings 2 to also be constructed in one piece if a corresponding joining technique ensures in this connection that embroidering of a window 2 does not warp the support material in the adjacent window. The support can be manually fed to an embroidery machine or the hoop or by means of an automatic feeding device and can be held securely in position there for the embroidering process.

Figure 1A:
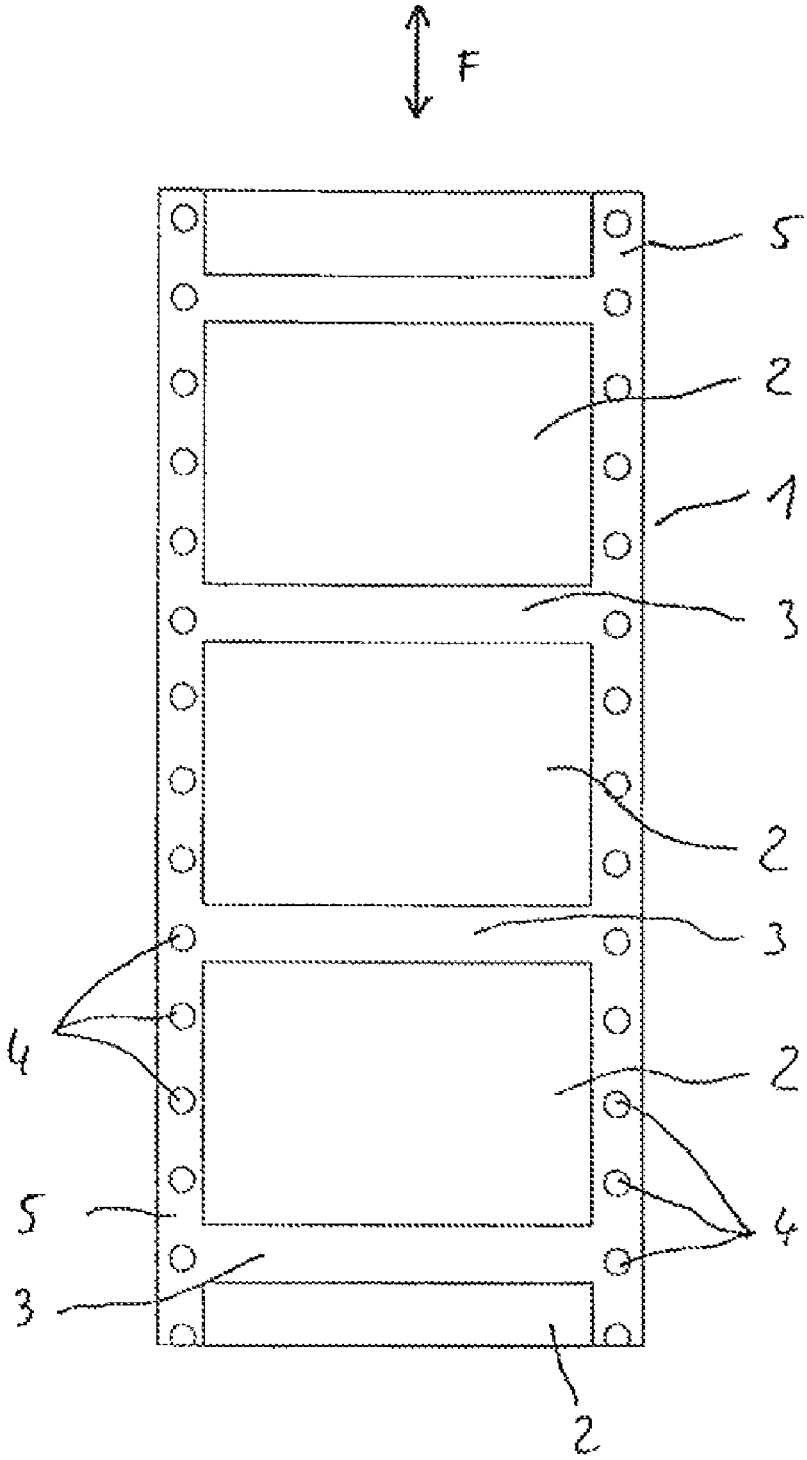
FIG. 1*a* shows a first embodiment of the support strip according to the invention without support material for embroidering.

FIG. 1*a* shows a plan view of a detail of a conveying belt 1 according to the invention which comprises rectangular, window-like—openings 2 arranged side by side in the conveying direction F which are bordered at the sides by edges 5. The edges 5 have catching openings 4 which cooperate with sprockets or sprocket rollers or sprocket belts of a conveying device according to FIG. 9 to 10. The window-like openings 2 are separated from each other by webs 3. The material of the conveying belt or the support 1 according to FIG. 1 is a relatively bend-resistant material, such as firm board, cardboard, or plastics material for example, so the edges 5 and the webs 3 form a material 6 can be fastened to the material of the support 1 using a wide variety of joining techniques. The opening 2 is surrounded by an edge 5 which ensures that the support material 6 for embroidering is always fixed so as to be taut. The lower embodiment illustrated in FIG. 1 shows a support with two window-like openings 2 of the same size and which are separated from each other by a web 3. The support material 6 for embroidering is constructed in two parts, one part respectively covering an opening 2, so embroidering of the left-hand support material does not affect the right-hand support material 6, so exact embroideries may be achieved. Of course it is possible for the support material 6 covering a plurality of openings 2 to also be constructed in one piece if a corresponding joining technique ensures in this connection that embroidering of a window 2 does not warp the support material in the adjacent window. The support can be manually fed to an embroidery machine or the hoop or by means of an automatic feeding device and can be held securely in position therefore the embroidering process.

FIG. 1*a* shows a plan view of a detail of a conveying belt 1 according to the invention which comprises rectangular, window-like—openings 2 arranged side by side in the conveying direction F which are bordered at the sides by edges 5. The edges 5 have catching openings 4 which cooperate with sprockets or sprocket rollers or sprocket belts of a conveying device according to FIG. 9 to 10. The window-like openings 2 are separated from each other by webs 3. The material of the conveying belt or the support 1 according to FIG. 1 is a relatively bend-resistant material, such as firm board, cardboard, or plastics material for example, so the edges 5 and the webs 3 form a stable frame for a support material for embroidering fastened to the support or conveying belt 1. Of course other materials are possible.

Figure 1B:
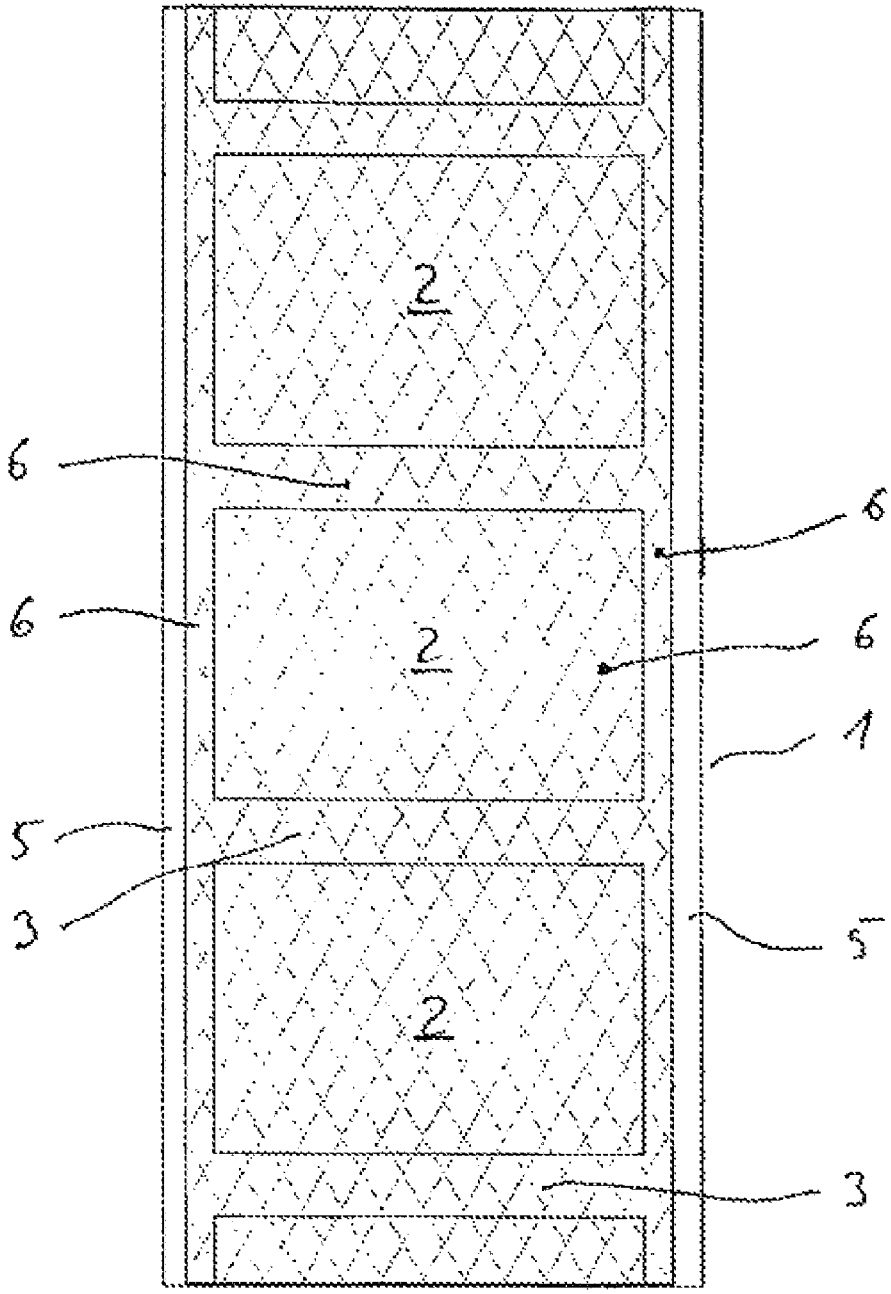
FIG. 1*b* shows a second possible embodiment of the support strip with support material for embroidering.
Figure 2:
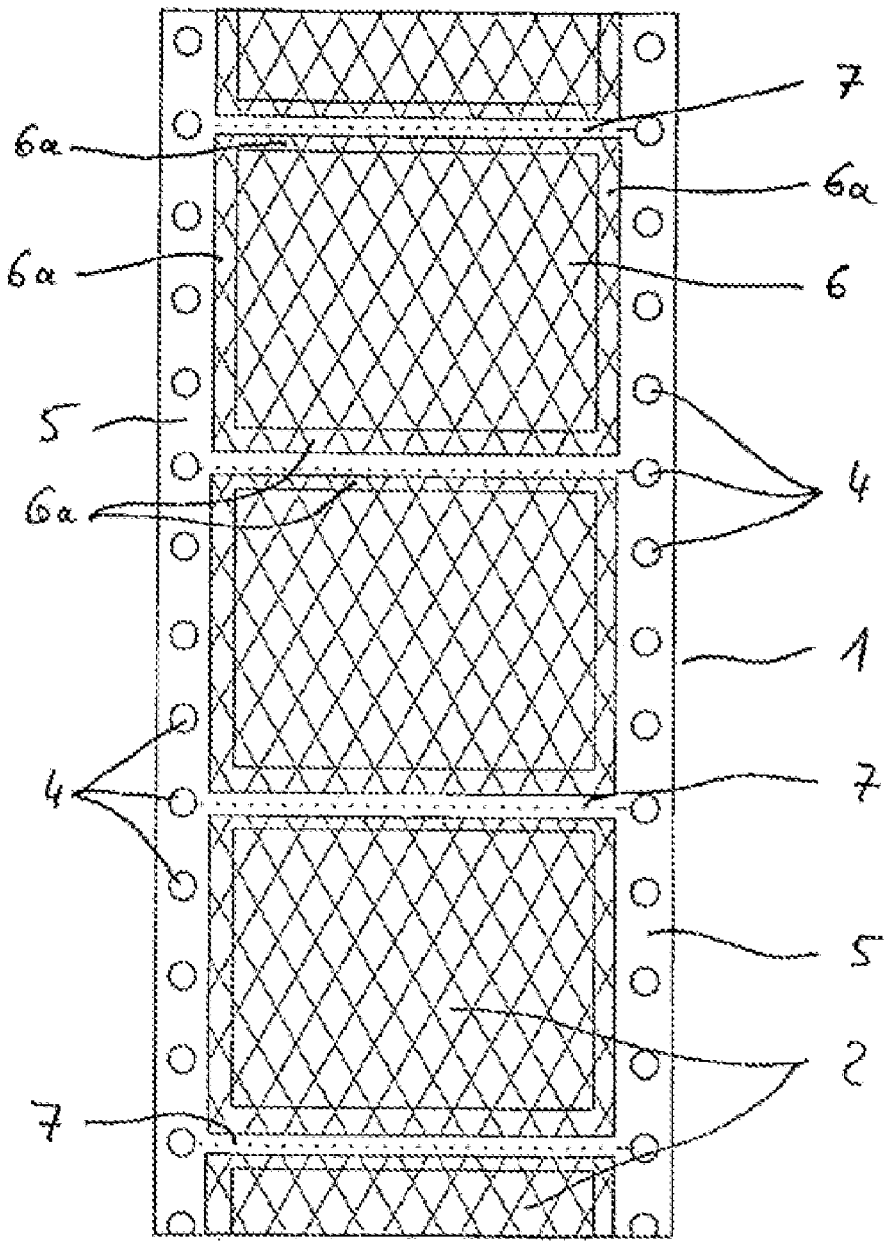
FIG. 2 shows a third possible embodiment of the support strip according to the invention with separated support material for embroidering.

As FIG. 1*b* shows the support material 6 for embroidering can be fastened as a continuous strip to the support strip 1, so it covers the window-like openings 2 However, it is also possible for the support material 6 for embroidering to cover the window-like openings 2 separately, so when embroidering the support material 6 of a window 2 the support material of the adjacent window(s) is not affected. Between the respective support materials 6 transversely extending perforations 7 (FIG. 2) can weaken the support strip, so manual separation of the individual windows with associated embroidered support material 6 is easily possible. The support material 6 is glued or fastened in some other way to the support strip 1 in the edge region 6*a* of the window-like openings 2.

Figure 3:
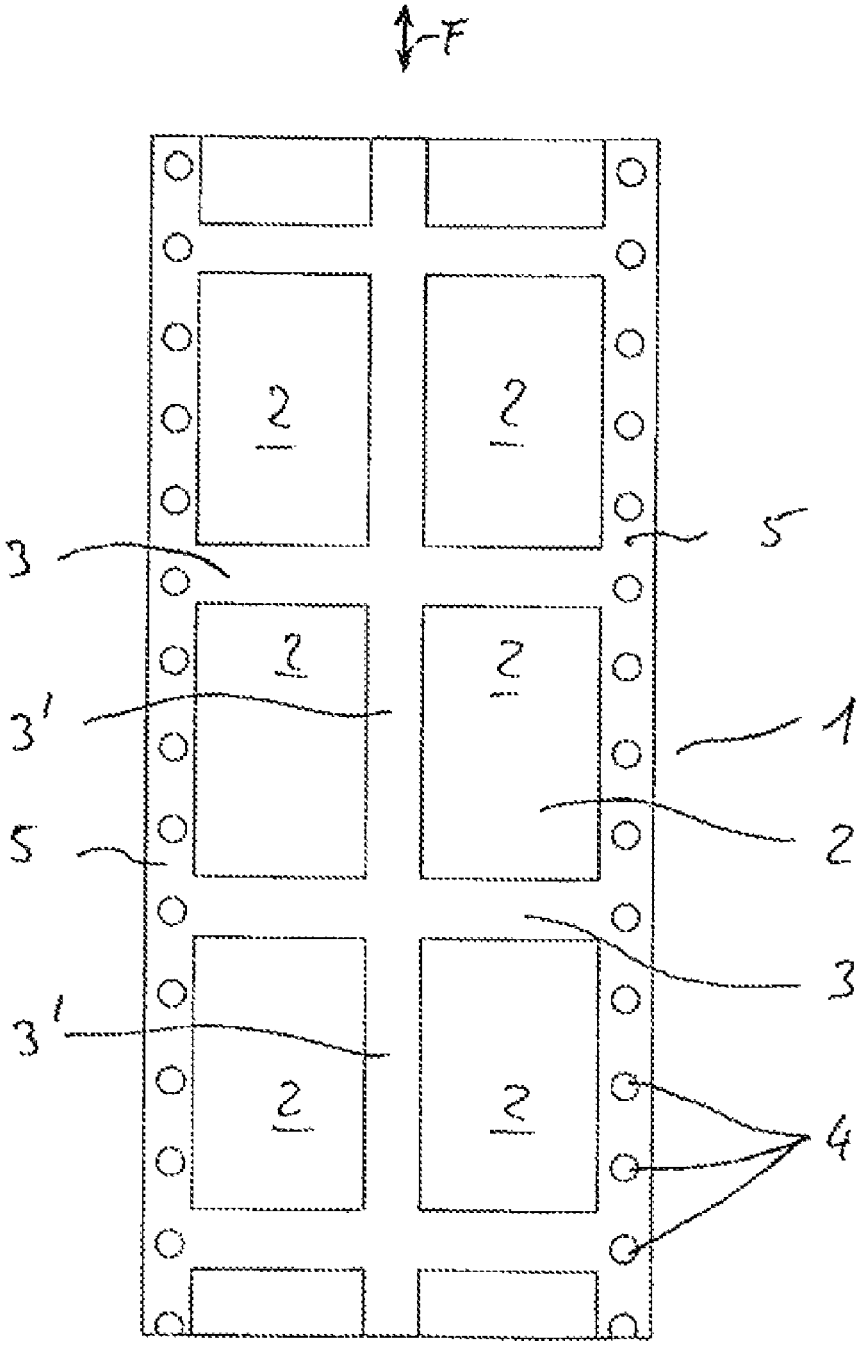
FIG. 3 to 6 show further embodiments of the support strip according to the invention.
Figure 4:
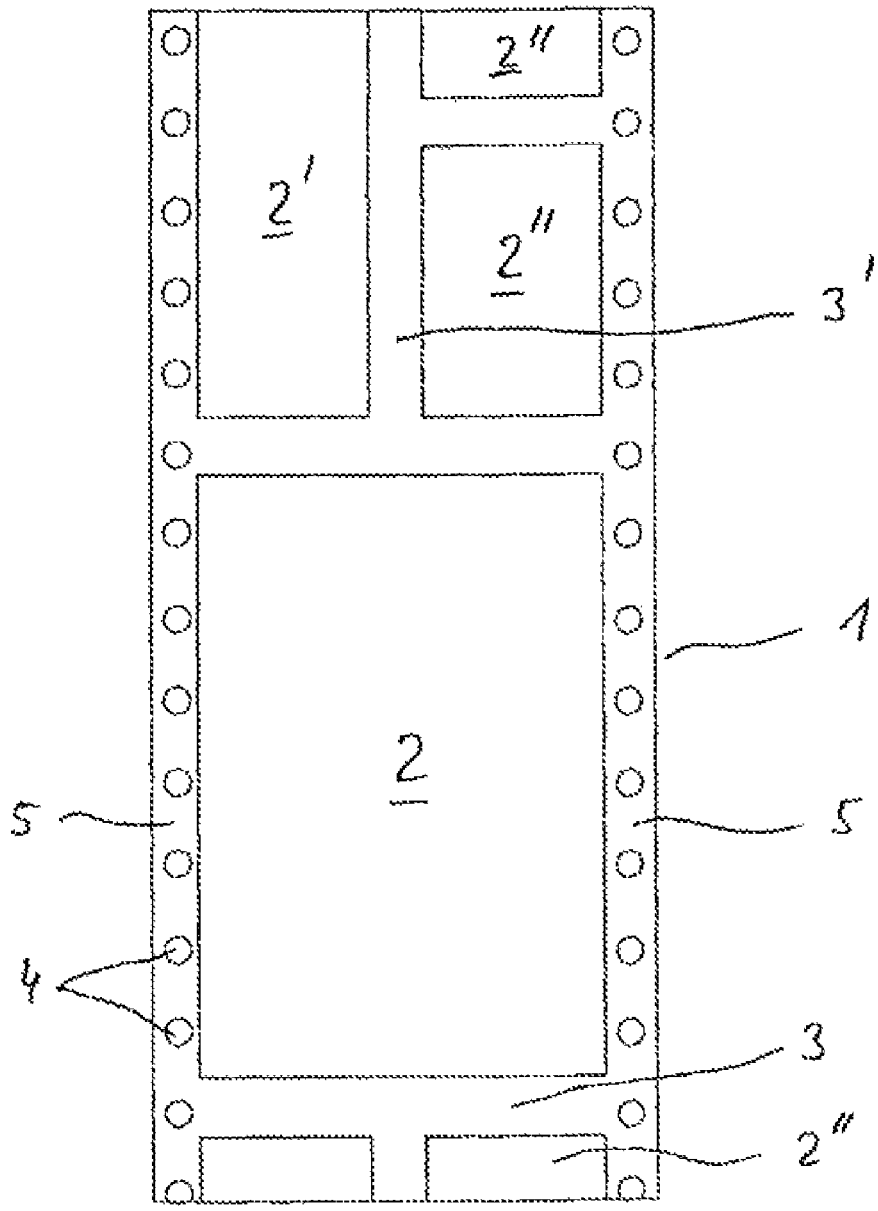
Figure 5:
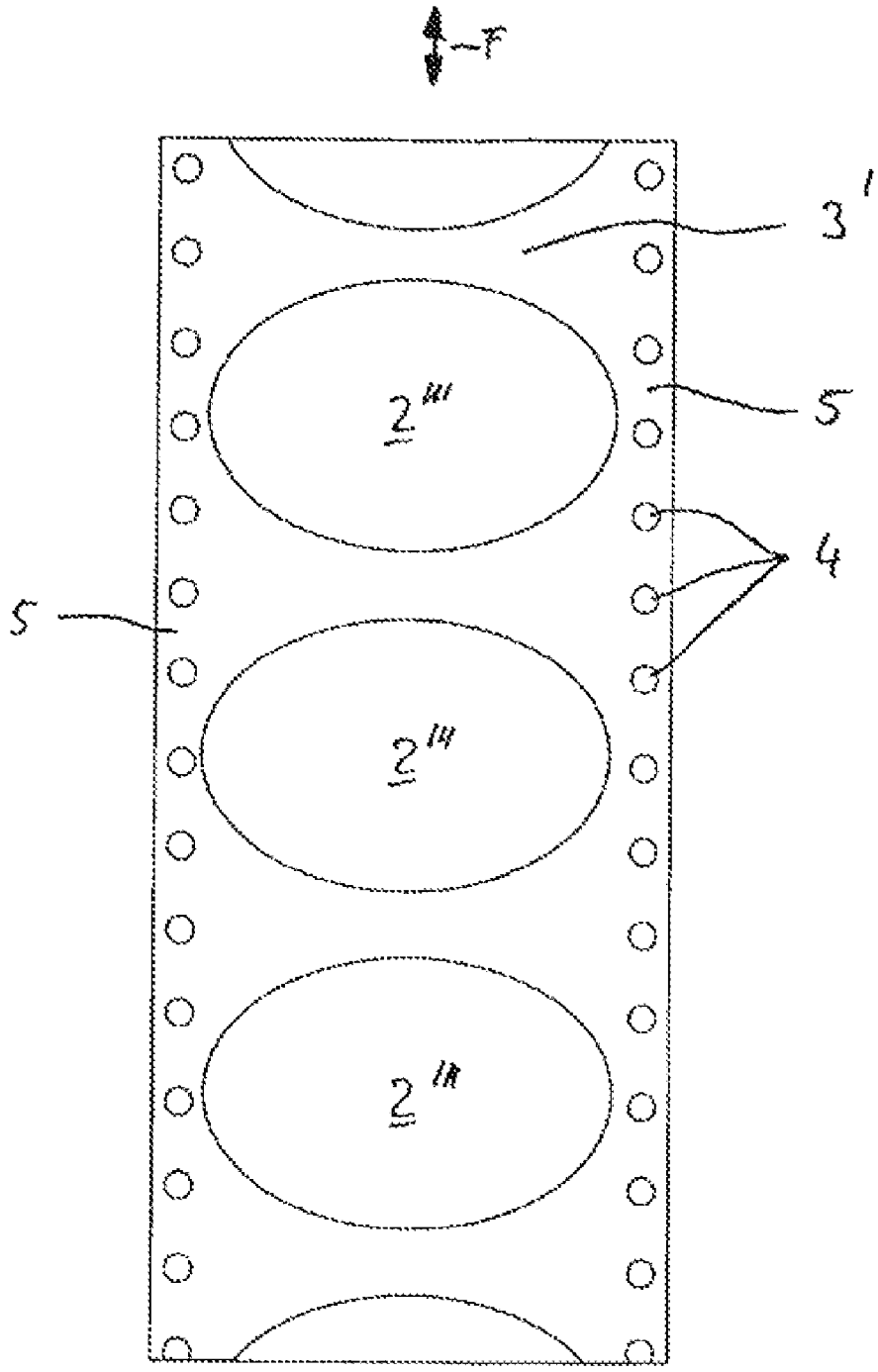

FIGS. 3, 4, 5, 5*a*, 6 and 6*a* show further possible embodiments of the support strip according to the invention. Thus FIG. 3 shows a support strip 1 with window-like openings 2 arranged side by side transversely to the conveying direction F, which openings are spaced apart from each other by a web 3' running in the conveying direction F. FIG. 4 shows a further alternative embodiment, windows 2, 2', 2" of different sizes being arranged in the conveying belt 1. FIG. 5 shows a further possible embodiment of the conveying belt in which the window-like openings 2'" are elliptical.

Figure 5A:
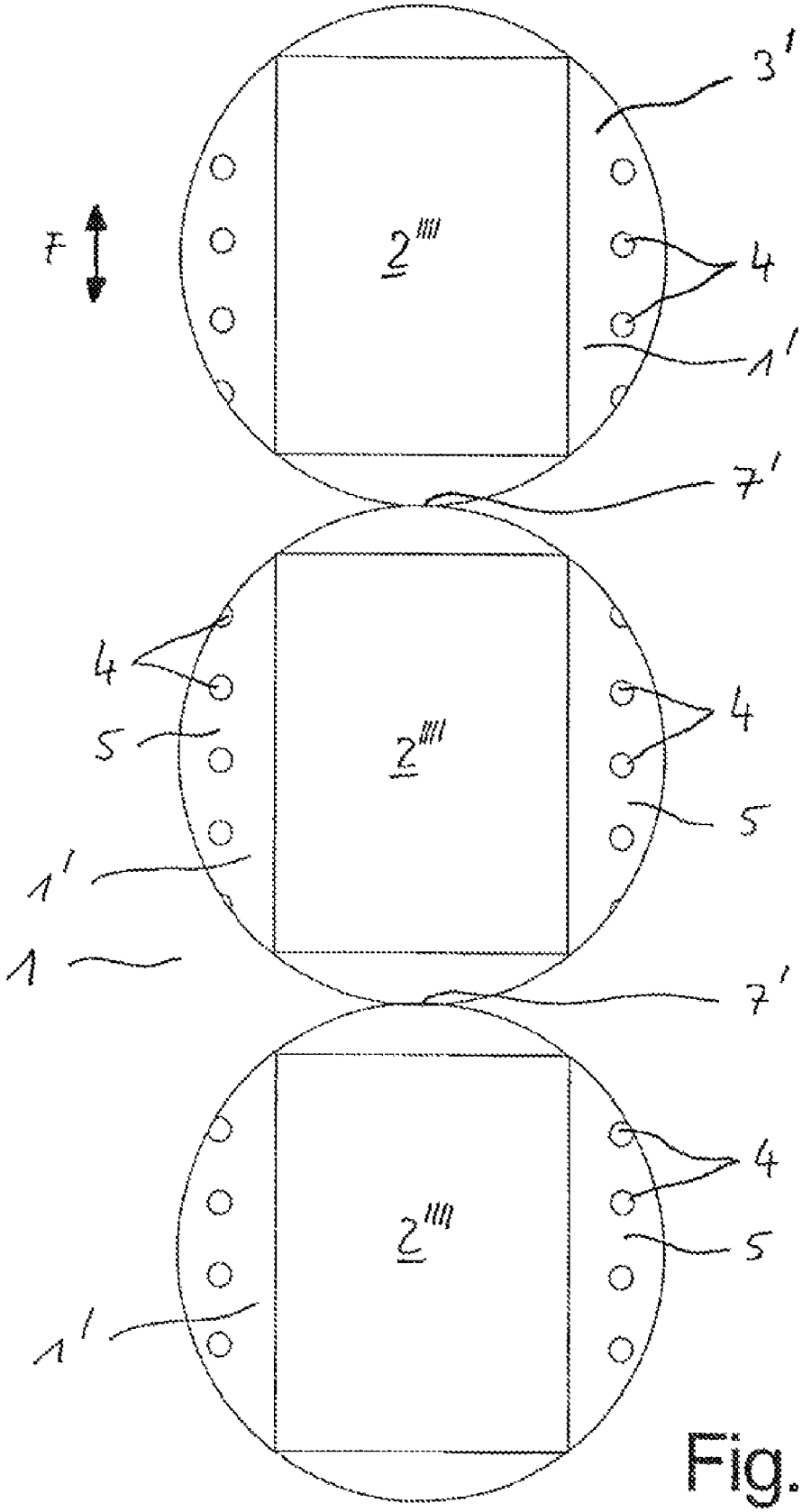

FIG. 5*a* shows a further alternative embodiment. The support strip 1 is comprised in this connection of circular sections 1' which are connected together. The individual sections 1' comprise rectangular window-like recesses 2"" which may be covered or overlapped with a support material (not shown). The joins or connection locations of the individual sections 1' comprise perforations 7', so after embroidering of the support material the individual sections 1' can be easily separated from each other and subsequently be positioned in standard round frames. The individual sections 1' also comprise edges 5 with catching openings 4, so they maybe conveyed by the conveying device according to the invention.

Figure 6:
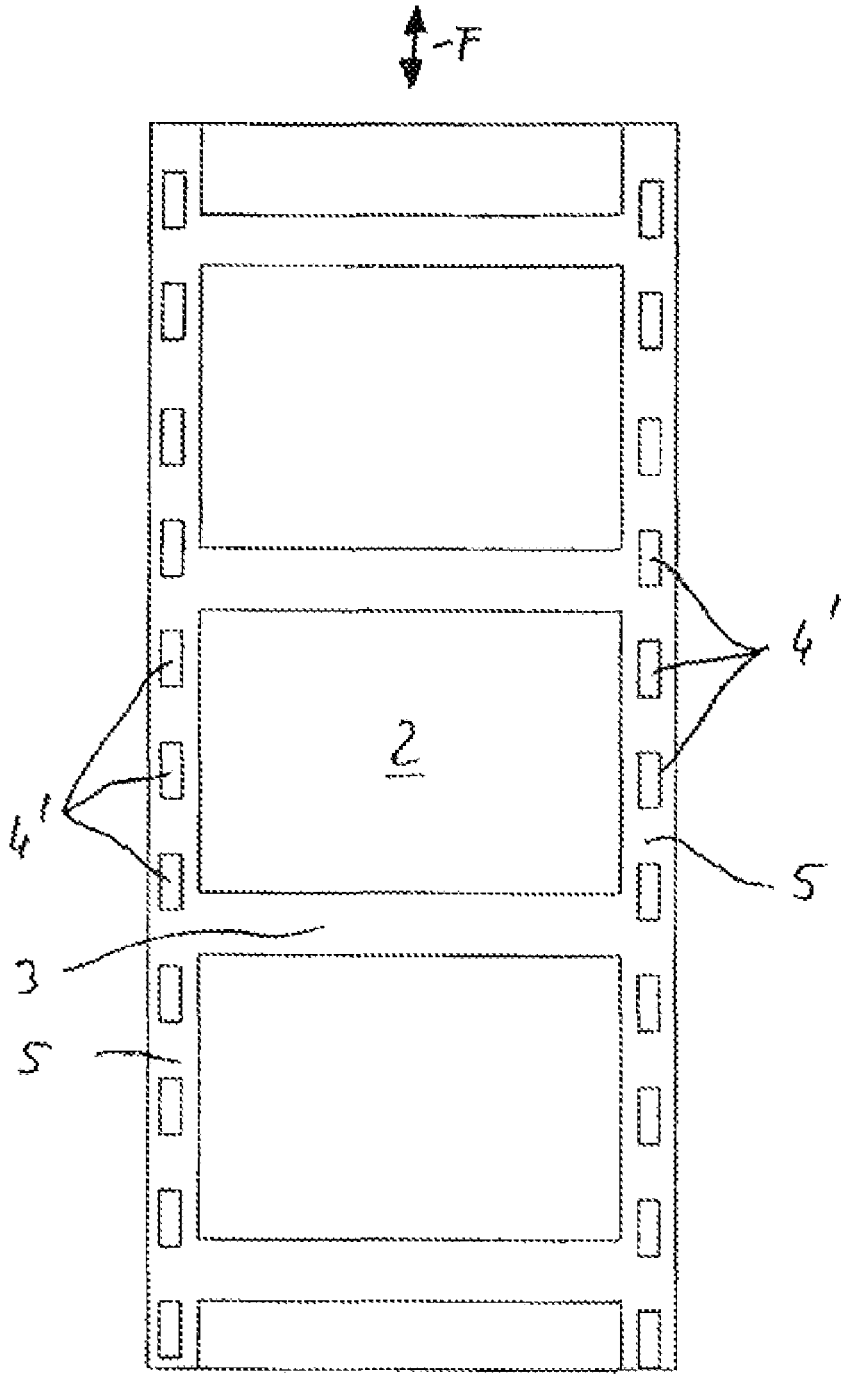
Figure 6A:
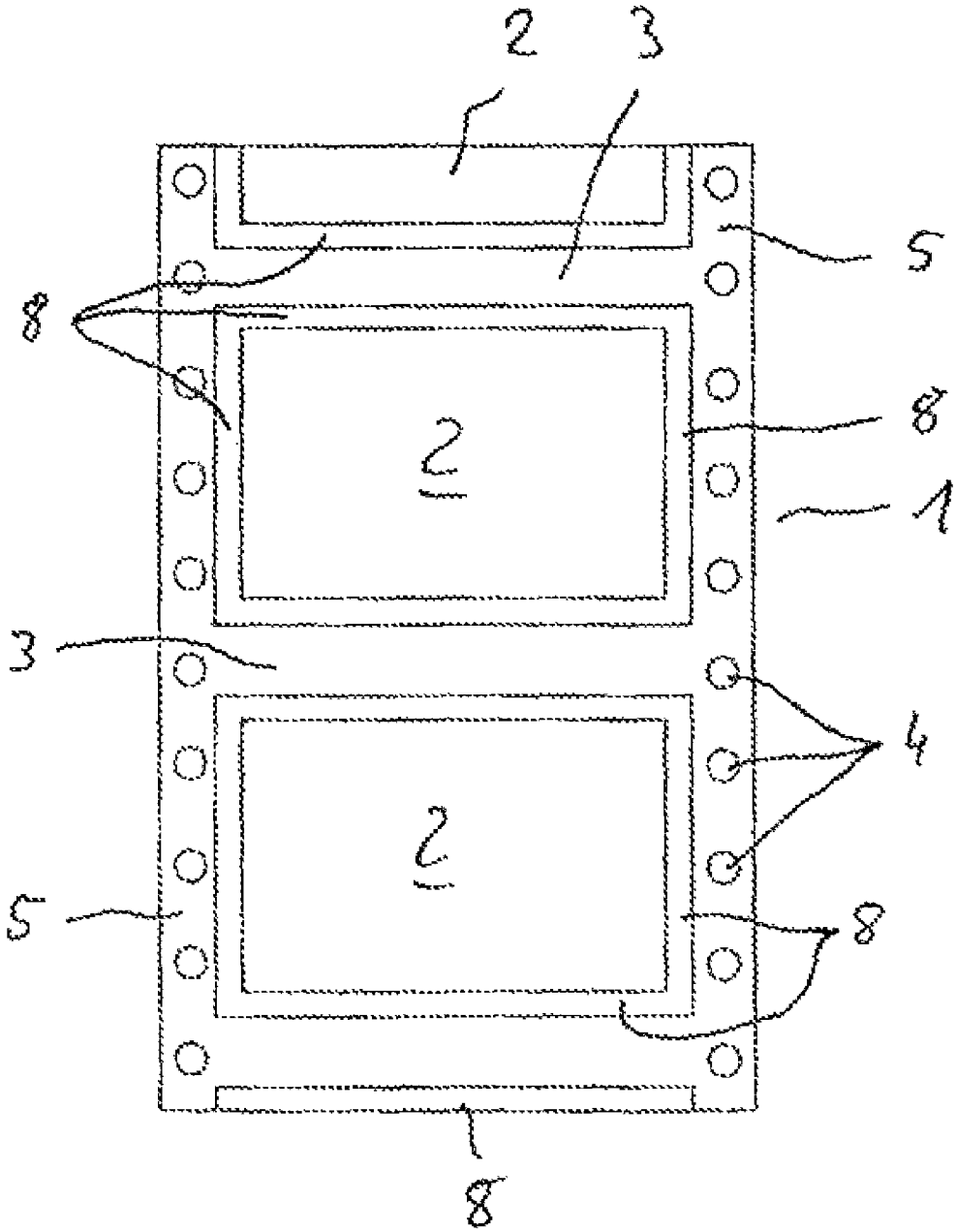
FIG. 6*a* shows the support strip with frame-like reinforcements for the window-like openings.

Of course with all above-described embodiments it possible to configure the catching openings 4' to be rectangular, as FIG. 6 shows. Reinforcements 8 (FIG. 6*a*) may also be fastened to the support strip 1 along the edges of the window-like openings 2, so an even more stable hoop is formed for the respective embroidery window. FIGS. 3 to 6*a* do not show the support material for embroidering.

Figure 7A:
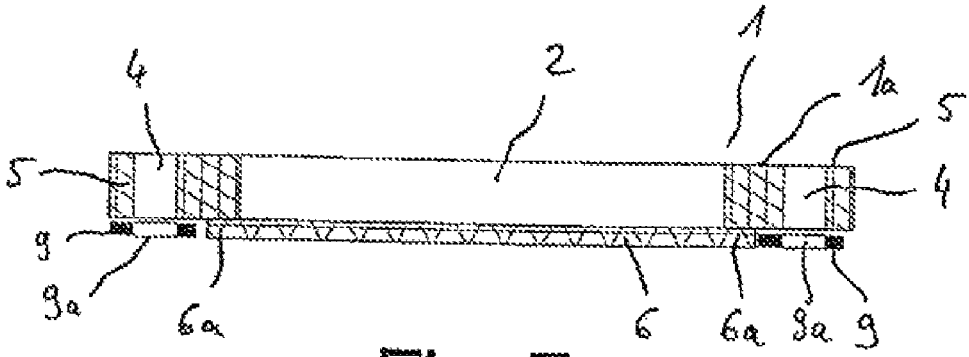
FIG. 7*a* to 7*c* show cross-sectional views through various embodiments of the support strip.
Figure 7B:
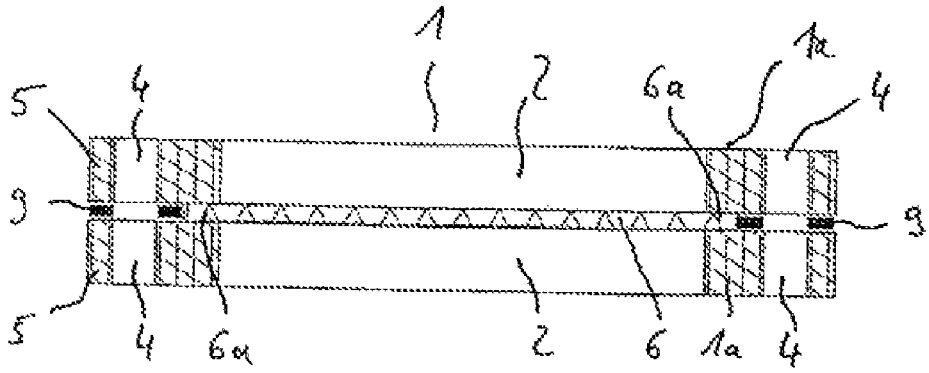
Figure 7C:
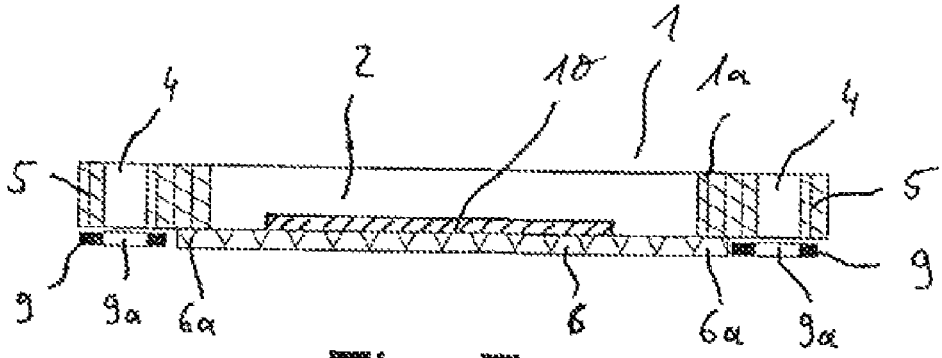

FIG. 7*a* to 7*c* show cross-sectional views through three possible embodiments of the support strip 1. The support strip 1 has a base body 1*a* which has window-like recesses 2. The lateral edges 5 have catching openings 4, it being possible for the lateral edges 5 to be reinforced by reinforcing strips 9 to window-like openings 9*a* corresponding to the catching openings 4. The support material 6 for embroidering is secured by its edge regions 6*a* to the support material 1*a* on the one flat side of the base body 1*a*. Securing can take place by means of gluing, welding or even embroidering. FIG. 7*b*, in contrast to FIG. 1*a*, shows a thicker embodiment of the support strip 1, the support material 6 for embroidering being inserted between two layers 1*a*. Reinforcing strips 9 can also be embedded between the two layers 1*a*. FIG. 7*c* shows a further embodiment of the support strip with support material 6 for embroidering secured thereto, in which an object 10, for example in the form of an emblem, which forms the surface for embroidering is secured to the support material 6.

In all above-described embodiments of the support strip the support material 6 for embroidering can be formed from a soluble embroidery material or film which in particular may be dissolved, without residue, by heat or the effect of water.

Figure 8:
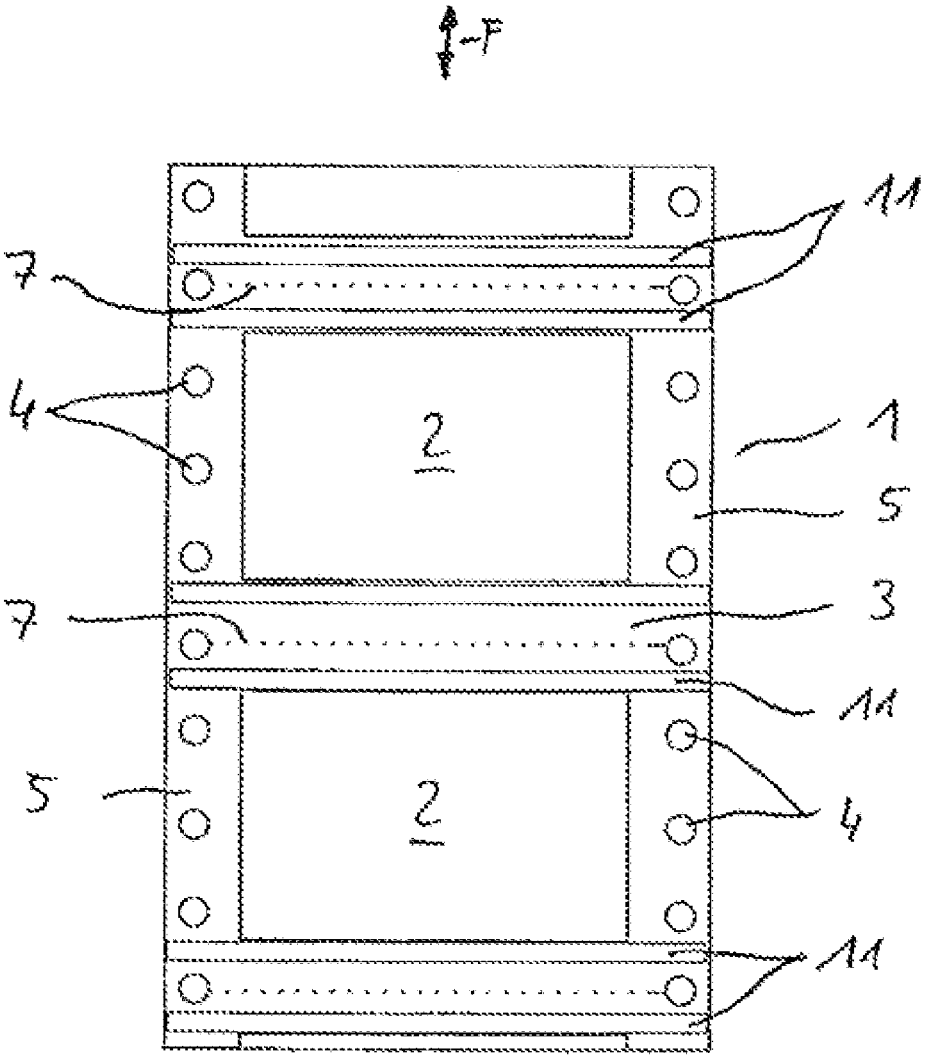
FIG. 8 shows a plan view of a support strip according to the invention with transversely extending reinforcing elements.

FIG. 8 shows a further possible embodiment of the support strip 1 according to the invention in which between the window-like openings 2 reinforcing webs 11 are secured to or inserted in the support material. Of course it is possible to arrange additional reinforcing strips, as shown for example in FIGS. 7*a* to 7*c*, on the support strip, along the edges 5, in the conveying direction.

Figure 9:
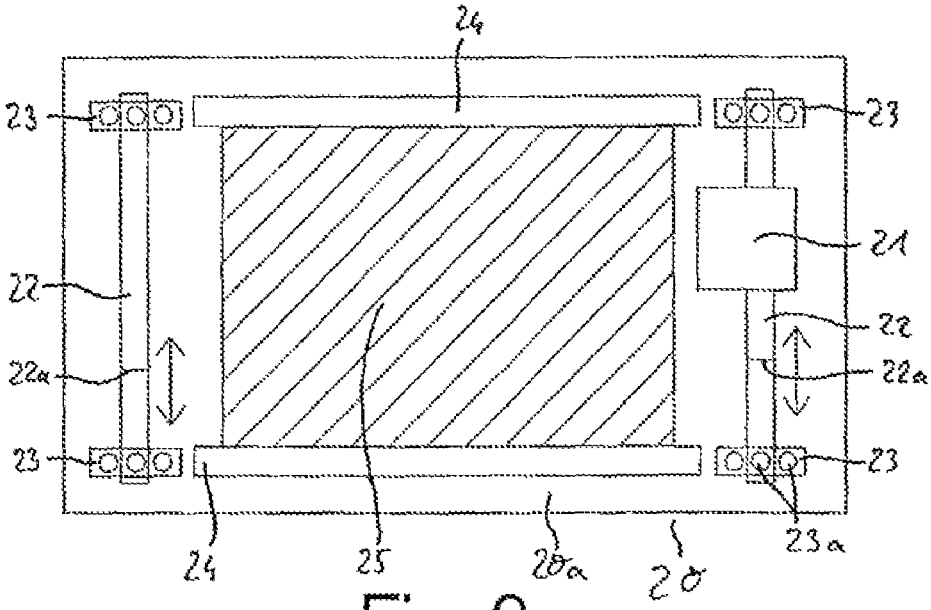
FIG. 9 shows a plan view of a first embodiment of a conveying device according to the invention.
Figure 9A:
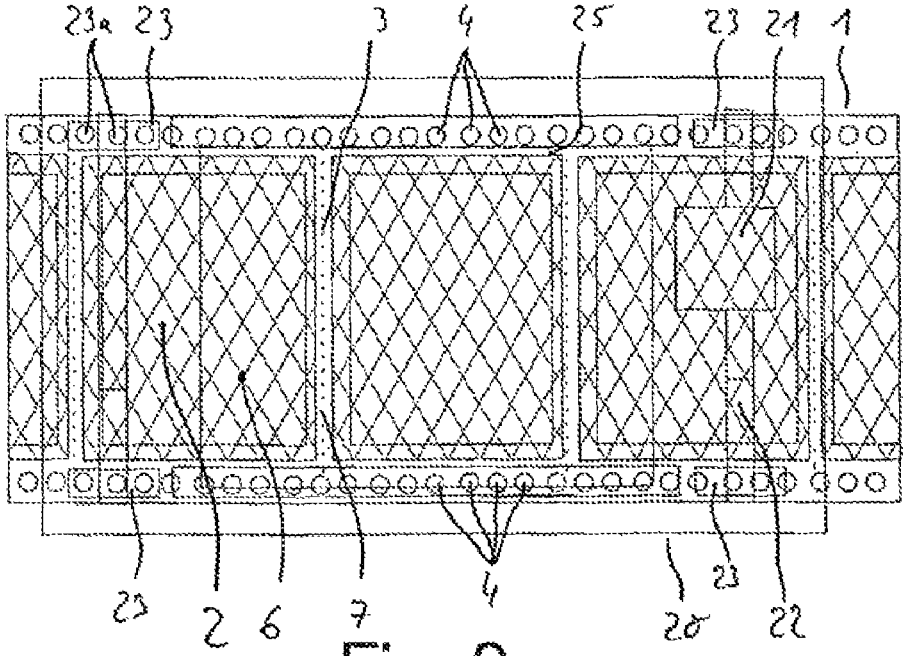
FIG. 9*a* shows the conveying device according to FIG. 9 with inserted conveying belt.
Figure 10:
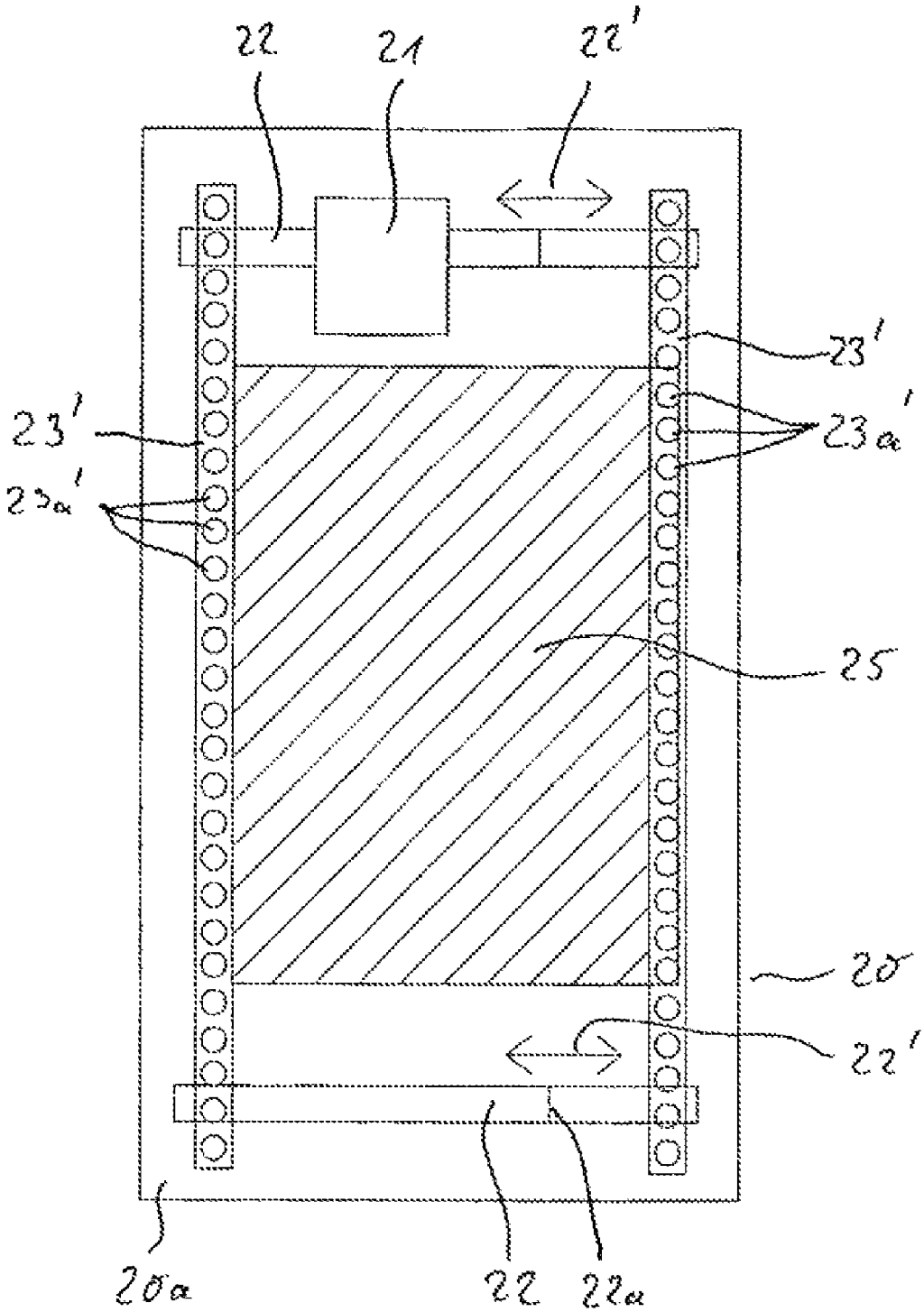
FIG. 10 shows a second possible embodiment of a conveying device with conveying belts.

FIGS. 9, 9*a* and 10 show two possible embodiments of a conveying device according to the invention for • a conveying belt according to FIGS. 1 to 8. The conveying device 20 comprises a frame 20*a* which forms a passage 25. The conveying device 20 has two shafts 22 to which sprocket wheel rollers 23 that are spaced from each other are secured and are used for conveying the conveying belt 1 shown in FIG. 9*a*. The sprocket wheel rollers reach with their sprockets 23*a* into the catching openings 4 of the conveying belt 1. The right-hand shaft 22 is driven by means of a drive 21. It is possible to drive the two shafts by means of separate drives, it being possible to synchronize the movement of the shafts by way of a controller, so automatic tautening of the conveying belt is also possible. Of course it is possible to connect the two shafts to each other by a gearing, so just one drive 21 is sufficient for synchronous driving of the shafts. The shafts can be telescopic, so they are extendable or shortenable (22*a*). The mutual spacing of the sprocket wheel rollers of a shaft may be varied hereby, so conveying belts of different widths may be conveyed using one and the same conveying device 20. Supports 24 for supporting the conveying belt sliding thereon are provided between the shafts. The window-like passage 25 should be at least the same size as a window-like opening 2 of the conveying belt. In its longitudinal extent (conveying direction) the passage 25 can be of such a size that a plurality of windows 2 can be positioned over the opening 25. The size of the window 25 determines the maximum area of the material 6 for embroidering, if the conveying belt is not moved by means of the conveying device 20 in the conveying direction thereof for embroidering one and the same support material 6 of an embroidery window 2.

FIG. 10 shows a second alternative embodiment of a conveying device 20 in which belts or bands 23' with sprockets 23*a*' situated thereon are used for conveying the conveying belt (not shown).

FIGS. 11 to 14 show different forms of use of an above-described conveying device for a multi-head embroidery machine. It is thus possible to feed a conveying belt 1 to a plurality of embroidering heads 32 of the multi-head embroidery machine 30 by means of a conveying device 20.

Figure 11:
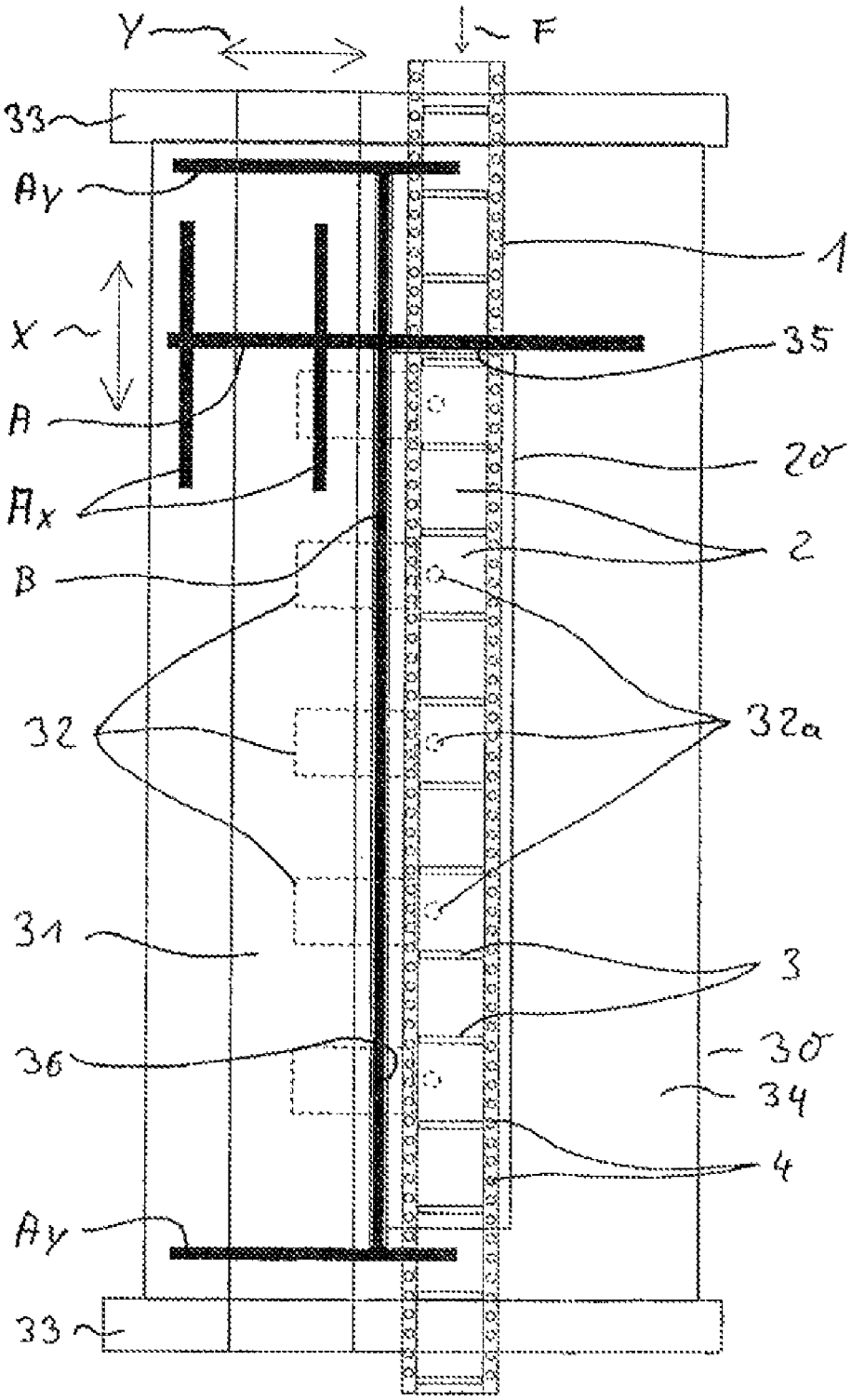
FIG. 11 shows a multi-head embroidery machine with a conveying device for a plurality of embroidering heads.

Care should be taken in this respect that the window-like openings 2 of the conveying belt 1 match the spacings of the embroidering heads 32 as far as possible, so it is always ensured that all embroidering heads with their needles 32*a* can respectively embroider a support material (not shown) tensioned over the respective window 2. The conveying device 20 of the embroidery machine according to FIG. 11 is moved by the embroidery frame or hoop drive A, B, $A_x$, $A_y$ in the X-Y plane during the embroidery process. The conveying device does not convey the conveying belt in the conveying direction F in the process. Only once the embroidery process has ended does the conveying device 20 convey the conveying belt 1 in the conveying direction to the extent that non-embroidered support materials are positioned under the embroidering heads 32.

The embroidering heads 32 are arranged on a crosspiece 31 which is supported on the base of the embroidery machine 30 by feet 33. The hoop drive comprises two drives $A_x$ and $A_y$ respectively for the X and Y directions, the drives driving two sleepers A and B on which the conveying device 20 is displaceably mounted in the X and Y directions.

Figure 12:
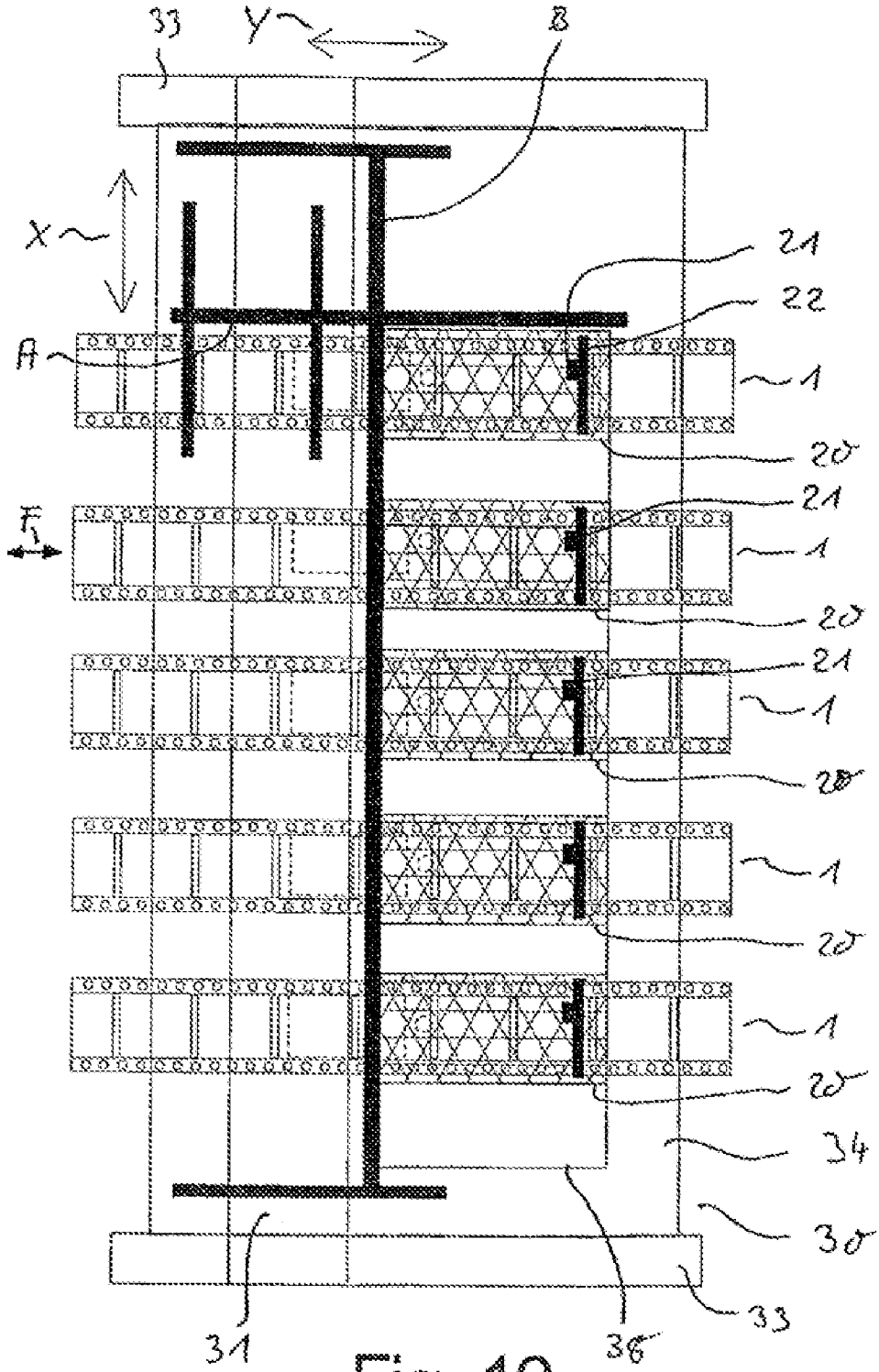
FIG. 12 shows a multi-head embroidery machine, with a conveying device being associated with each embroidering head by feeding of one conveying belt respectively.

The embroidery machine according to FIG. 12 is basically constructed in the same way as the embroidery machine according to FIG. 11. The only difference lies in the fact that a conveying device 20 is associated with each embroidering head and that the conveying directions with the conveying belts 1 are twisted or rotated by 90° with respect to the conveying device of the embroidery machine in FIG. 11. Each conveying device of the embroidery machine according to FIG. 12 comprises its own drive 21 with associated drive shaft 22.

Figure 13:
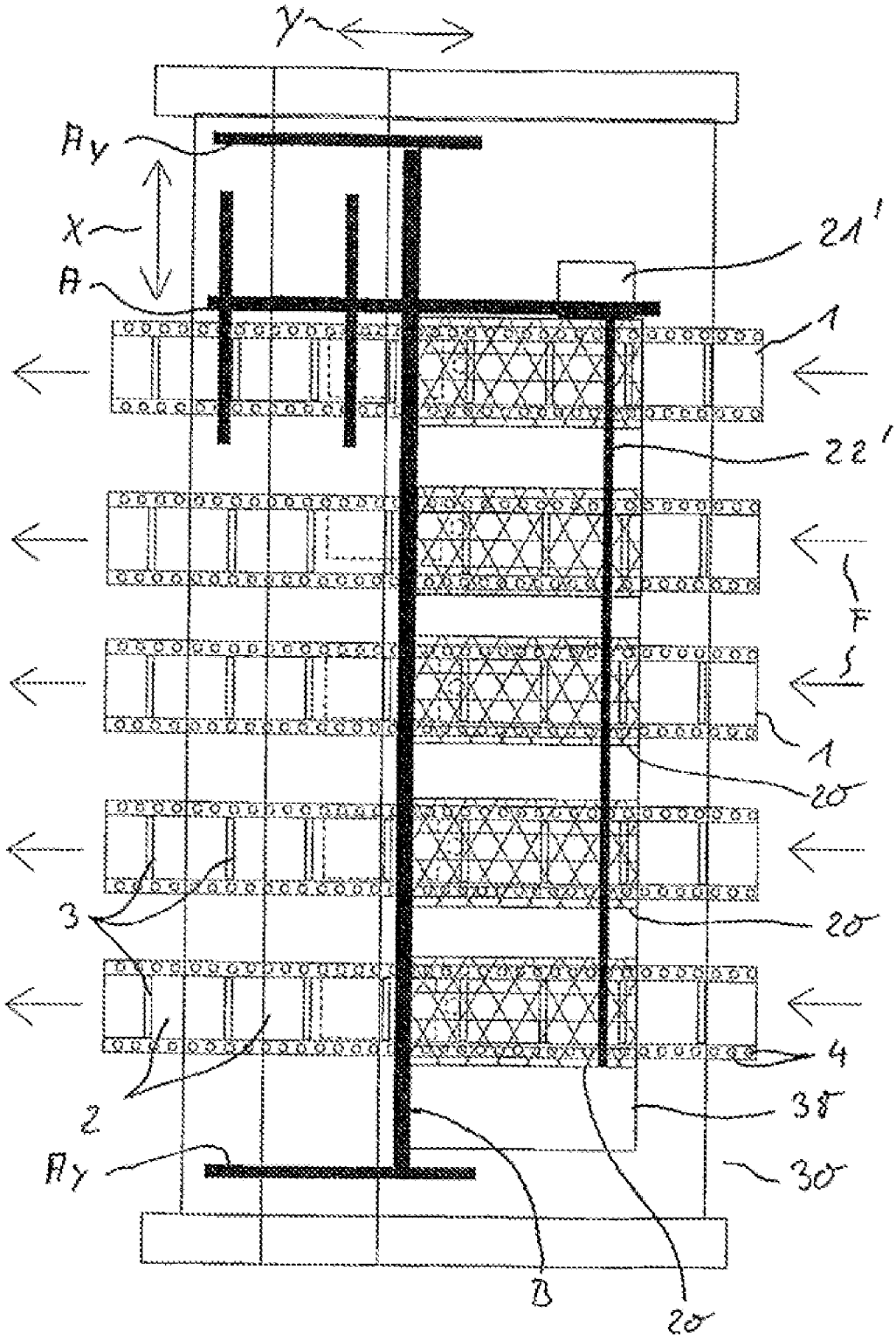
FIG. 13 shows a machine according to FIG. 13, all conveying devices being driven by means of a common drive and a common drive shaft.

The embroidery machine according to FIG. 13 differs from the embroidery machine according to FIG. 12 in that all conveying devices 20 are synchronously driven by means of a common drive 21 and a continuous drive shaft 22'.

Figure 14:
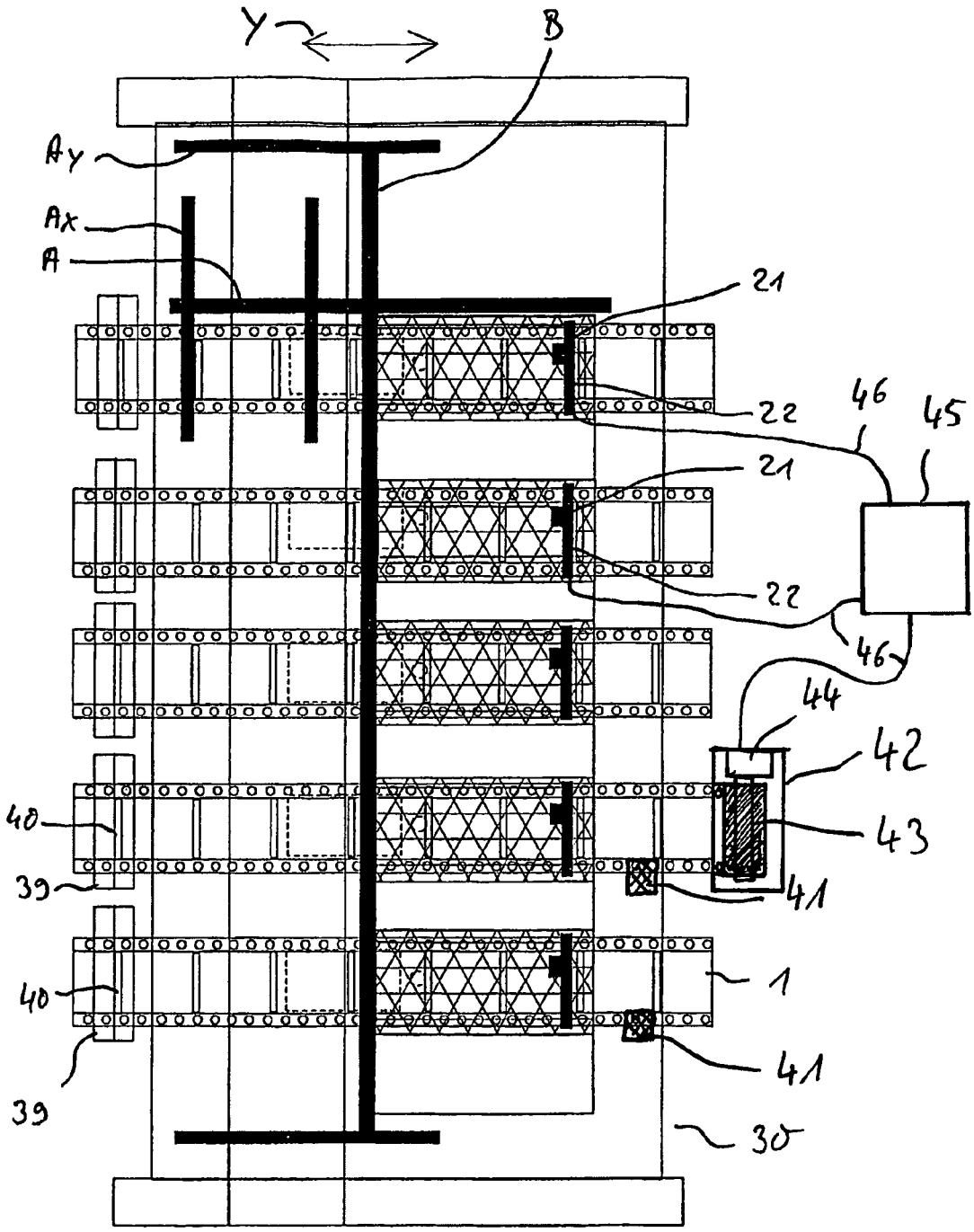
FIG. 14 shows a multi-head embroidery machine according to FIG. 12 with cutting mechanisms for separating the embroidered conveying belts.

The embroidery machine in FIG. 14 is constructed in the same way as the embroidery machine in FIG. 12, although for separation of the conveying belt 1 a cutting mechanism 39 with a blade 40 is allocated. FIG. 14, however, further shows the positions sensors 41 as well as the dispenser 42, which includes the drive 44 and the support-coil 43. The feed controller and controller 46 are connected to the conveying devices 20 and dispenser 42 via data links 46.

Figure 15:
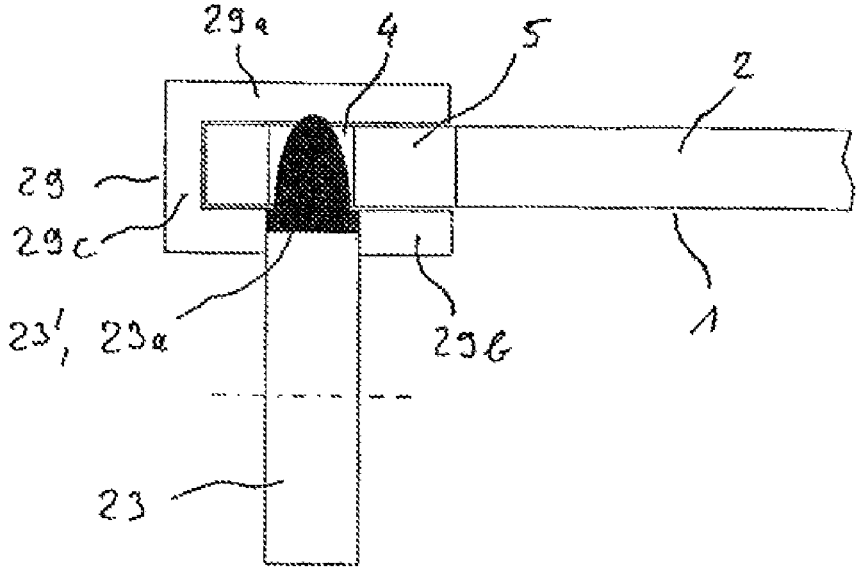
FIG. 15 shows a cross-sectional view through a detail of the conveying device, the conveying belt being driven by means of a sprocket belt or cam belt.
Figure 16:
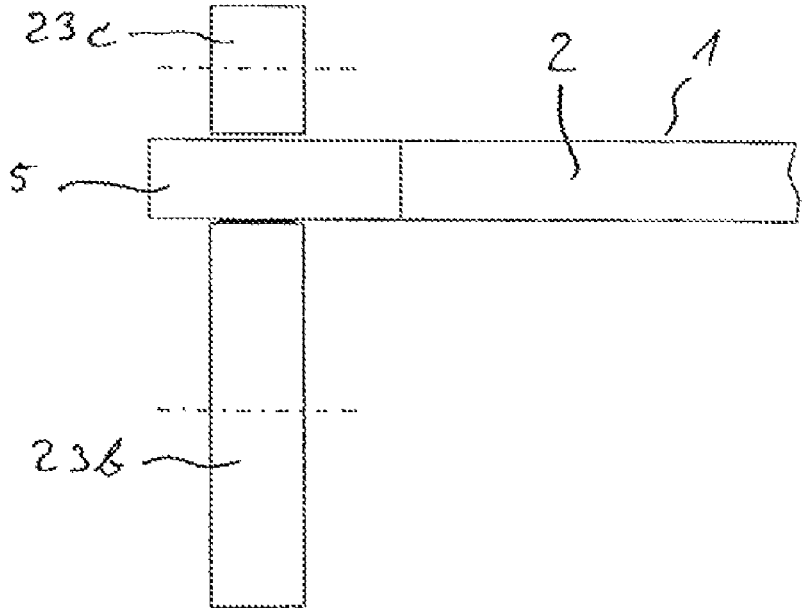
FIG. 16 shows a roller drive for the feed motion of the conveying belt.

FIGS. 15 and 16 show, in cross-section, a detail of the conveying drive for a support strip 1. The support strip 1 has window-like openings 2 which are limited at the side by an edge 5. The lateral edge 5 has catching openings 4 through which sprockets 23', 23*a* of the drive pass. The sprockets are arranged either on a driving belt or a sprocket wheel roller 23. For lateral guiding the conveying device comprises a guide 29 which completely surrounds the edge 5. This guide 29 can extend over the entire length of the conveying device. FIG. 16 shows an alternative drive for a support strip 1, the edge 5 not comprising any catching openings 4 according to FIG. 15. The edge 15 is inserted so as to be pressed between an upper pressure roller 23*c* and the lower drive wheel 23*b* and so as not to slip, so by turning the drive wheel 23*b* the support strip 1 can be moved in the conveying direction.

It is understood that further possible types of drive that are obvious to a person skilled in the art are also incorporated by this invention.

The specification incorporates by reference the disclosure of German 10 2004 054 121.3 filed Nov. 8, 2004, as well as International application PCT/EP2005/1009395, filed Sep. 1, 2005.

The present invention is, of course, in no way restricted to the specific disclosure of the specification and drawings, but also encompasses any modifications within the scope of the appended claims.

The invention claimed is:

1. A support for a material to be embroidered, comprising:

a support material (6) adapted to be embroidered;

a strip-shaped support (1) that in a conveying direction (F) thereof and/or transversely to said conveying direction is provided with a plurality of window-like openings (2, 2', 2'', 2''') for passage of an embroidery needle, wherein said window-like openings are adapted to be covered by said support material (6) that is adapted to be embroidered, wherein said support material (6) that is adapted to be embroidered is a soluble embroidery film that is heat-soluble or water-soluble, or wherein said support material (6, 10) that is adapted to be embroidered is a fabric, knitted fabric or braiding, and is glued or fused to said strip-shaped support (1).

2. A support according to claim 1, wherein said strip-shaped support (1) is provided with a flat side that is adapted to support said support material (6) that is adapted to be embroidered.

3. A support according to claim 1, wherein said strip-shaped support (1) is provided with at least two layers (1*a*), and wherein said support material (6) that is adapted to be embroidered is adapted to be embedded between two of said layers.

4. A support according to claim 1, wherein said support material (6) that is adapted to be embroidered covers a respective one of said window-like openings (2) and is not unitary with support material (6) covering an adjacent one of said window-like openings (2).

5. A support according to claim 1, wherein said support material (6) that is adapted to be embroidered is in the form of a strip that is glued or fused to said strip-shaped support (1, 1*a*).

6. A support according to claim 1, wherein catching openings (4) or press-on strips configured to engage with a conveying or advancing device (20) are provided on sides of said strip-shaped support (1) as viewed in said conveying direction (F).

7. A support according to claim 6, wherein said catching openings (4) are circular, elliptical or rectangular.

8. A support according to claim 1, wherein said window-like openings (2, 2', 2", 2'") are rectangular, circular or elliptical.

9. A support according to claim 1, wherein edges of said window-like openings (2) are reinforced with a bend-resistant material (8).

10. A support according to claim 1, wherein said strip-shaped support (1), in the region of longitudinal sides (5) thereof, is provided with reinforcements (9) that are glued or fused to said strip-shaped support (1) or are embedded therein.

11. A support according to claim 1, wherein said strip-shaped support (1) is provided with at least one reinforcing web or strut that extends between said window-like openings (2) transverse to said conveying direction (F).

12. A support according to claim 1, wherein said strip-shaped support (1) includes a base body (1*a*) that is made of a material that is more bend-resistant than said support material (6) that is adapted to be embroidered.

13. A support according to claim 1, wherein perforations (7) are disposed between said window-like openings (2) for an easier and precise separation of individual ones of said window-like openings.

14. A support according to claim 1, wherein said strip-shaped support (1) is made of cardboard, plastic or fiber-reinforced material.

15. A support according to claim 1, wherein a further support material (10) that is adapted to be embroidered is made of non-soluble material and is secured by being glued, fused or sewn to said soluble embroidery film (6).

16. A support according to claim 1, wherein said strip-shaped support (1) is adapted to be wound on a drum.

17. A support according to claim 1, wherein said strip-shaped support (1) is bend-resistant and is divided into sheets, wherein individual ones of said sheets are joined together via hinge means in such a way that the sheets are adapted to be stacked upon one another as a continuous stack.

18. A support according to claim 17, wherein said hinge means are formed by perforated regions of said strip-shaped support (1).

19. A support according to claim 1, wherein said strip-shaped support (1) is provided with markings for a positioning of said strip-shaped support in a transport direction, wherein said markings are color markings, holes or reflective regions.

20. A conveying device for a strip-shaped support (1) according to claim 1, comprising:

at least one drive mechanism for displacement of said conveying device (20) in at least one of the X and Y directions;

securing means for securement of said conveying device (20) to said at least one drive mechanism; and a drive (21, 21'), wherein said strip-shaped support (1) is adapted to be moved in or counter to said conveying direction (F) by said drive, and wherein said conveying device (20) has at least one passage (25) for at least one embroidery needle, and wherein at least one of said window-like openings (2) of said strip-shaped support (1) is adapted to be positioned over said at least one passage (25) for embroidery of said support material (6, 10).

21. A conveying device according to claim 20, wherein said conveying device (20) is provided with support elements (24) for support of said strip-shaped support (1) during conveying and/or embroidering.

22. A conveying device according to claim 20, wherein said conveying device (20) is provided with a plurality of said passages (25) separated from one another by support elements that are disposed transverse to said conveying direction (F), and wherein said strip-shaped support (1) is adapted to be supported on said support elements.

23. A conveying device according to claim 20, wherein said drive (21, 21') is provided with at least one of pressure rollers, sprocket wheel rollers, and sprocket belts.

24. A conveying device according to claim 23, wherein said conveying device (20) is provided with at least two shafts (22), at least one of which is driven, and wherein said at least one passage (25) is disposed between said shafts (22).

25. A conveying device according to claim 24, wherein at least one pressure roller or sprocket wheel roller is disposed on each of said shafts (22).

26. A conveying device according to claim 25, wherein said shafts drive two spaced-apart conveying belts, and wherein said conveying belts are provided with projections that are adapted to engage in corresponding catching openings of said strip-shaped support (1).

27. A conveying device according to claim 26, wherein a spacing of pressure rollers, sprocket wheel rollers or conveying belts on a given shaft relative to one another can be set and can be adjusted to a respective width of said strip-shaped support (1) that is to be conveyed.

28. A conveying device according to claim 20, wherein said conveying device (20) is provided with at least one of a cutting mechanism, a strip-shaped support dispenser, and position sensors for positioning of said strip-shaped support (1).

29. An embroidery machine or sewing machine comprising a conveying device (20) according to claim 20, wherein said at least one drive mechanism, for a hoop, is adapted to displace said conveying device (20) in at least one of the X and Y directions.

30. An embroidery machine or sewing machine according to claim 29, wherein during embroidery of said support material (6), said machine is adapted to move said conveying device (20) in either only said X direction or said Y direction, and wherein said strip-shaped support (1) is adapted to be moved via said drive (21, 21') of said conveying device (20) in the respective other direction.

31. An embroidery machine or sewing machine according to claim 29, wherein said conveying device (20) is adapted to extend below a plurality of embroidering heads of said machine, and wherein via said plurality of said embroidering heads it is possible to simultaneously provide a plurality of embroideries on said strip-shaped support (1), or on said support material (6) thereof, disposed in said conveying device (20).

32. An embroidery machine or sewing machine according to claim 29, wherein said machine is provided with a plurality of embroidering heads that are disposed next to one another in the X direction, and wherein a respective conveying device (20) is disposed below each embroidering head for conveying a respective strip-shaped support.

33. An embroidery machine or sewing machine according to claim 29, wherein at least one dispenser for said strip-shaped support is secured to a frame of said machine or to said drive mechanism of said conveying device (20).

34. An embroidery machine or sewing machine according to claim 29, wherein said machine is provided with guides for guiding a strip-shaped support (1) that is adapted to pass from a strip-shaped support dispenser to said conveying device (20), or from said conveying device (20) to a stacker.

35. An embroidery machine or sewing machine according to claim 29, wherein for each conveying device (20) said machine has at least one separating unit, wherein said separating unit is a cutting mechanism.

36. An embroidery machine or sewing machine according to claim 29, wherein said conveying device (20) is provided with at least as many passages (25) as said machine has embroidering heads.

37. An embroidery machine or sewing machine according to claim 29, wherein said machine has a controller, and wherein said conveying device (20) is provided with a feed controller that communicates with said machine controller.

38. A support according to claim 1, wherein an object for embroidering is applied or secured to the support material and is configured to be exactly positioned relative to an embroidery machine via the support strip itself.

* * * * *

UNITED STATES PATENT AND TRADEMARK OFFICE

CERTIFICATE OF CORRECTION

PATENT NO. : 7,930,982 B2
APPLICATION NO. : 11/718877
DATED : April 26, 2011
INVENTOR(S) : Sekip Surget It is certified that error appears in the above-identified patent and that said Letters Patent is hereby corrected as shown below:

Title Page; item (57)

In the last sentence of the Abstract, the word "sawing" is incorrect. The last sentence of the Abstract should read as follows:

An embroidery machine or sewing machine incorporating the conveying device is also provided.

Signed and Sealed this
Fourteenth Day of June, 2011

David J. Kappos

David J. Kappos
*Director of the United States Patent and Trademark Office*